US007243997B1

(12) United States Patent
Tornero

(10) Patent No.: US 7,243,997 B1
(45) Date of Patent: Jul. 17, 2007

(54) POSITIONING DEVICE FOR FURNITURE

(76) Inventor: Lino E. Tornero, 809 Quailmeadow La., Colfax, NC (US) 27235

( * ) Notice: Subject to any disclaimer, the term of this patent is extended or adjusted under 35 U.S.C. 154(b) by 393 days.

(21) Appl. No.: 10/760,991

(22) Filed: Jan. 20, 2004

(51) Int. Cl.
*A47C 7/54* (2006.01)

(52) U.S. Cl. ..... 297/411.37; 297/383

(58) Field of Classification Search ..... 297/353, 297/383, 411.35, 411.36, 411.37; 312/334.1, 312/334.36; 403/80; 384/42
See application file for complete search history.

(56) References Cited

U.S. PATENT DOCUMENTS

| | | | | |
|---|---|---|---|---|
| 1,711,158 | A | 4/1929 | Rece | |
| 2,012,530 | A | 8/1935 | Eustis | |
| 2,256,944 | A | 9/1941 | Fall | |
| 2,703,601 | A | 3/1955 | Wood | |
| 2,773,544 | A | 12/1956 | Dusenbury | |
| 2,988,398 | A | 6/1961 | Hamilton | |
| 3,588,198 | A | 6/1971 | Stewart | |
| 3,720,443 | A | 3/1973 | Mourgue | |
| 4,036,525 | A | 7/1977 | Howk | |
| 4,043,592 | A | 8/1977 | Fries | |
| 4,451,084 | A | 5/1984 | Seeley | |
| 4,568,050 | A | 2/1986 | Radoy et al. | |
| 4,613,106 | A | 9/1986 | Tornero | |
| 4,616,812 | A | 10/1986 | Tornero | |
| 4,639,039 | A | 1/1987 | Donovan | |
| 4,660,885 | A | 4/1987 | Suhr et al. | |
| 4,720,068 | A | 1/1988 | Tornero | |
| 4,749,230 | A | 6/1988 | Tornero | |
| 4,815,688 | A | 3/1989 | Wood | |
| 4,930,840 | A | 6/1990 | Tornero | |
| 5,082,328 | A | 1/1992 | Garelick | |
| 5,324,096 | A | 6/1994 | Schultzl | |
| 5,338,133 | A | 8/1994 | Tornero | |
| 5,388,892 | A | 2/1995 | Tornero | |
| 5,586,809 | A | 12/1996 | Szmadzinski | |
| 5,586,811 | A | 12/1996 | Tornero | |
| 5,597,204 | A | 1/1997 | Karaus, Jr. | |
| 5,607,238 | A | 3/1997 | Sherman | |
| 5,649,741 | A | 7/1997 | Beggs | |
| 5,660,442 | A | 8/1997 | Tornero | |
| 5,678,892 | A | 10/1997 | Heitlinger | |
| 5,685,609 | A | 11/1997 | Miotto | |
| 5,695,249 | A | 12/1997 | Lotfi | |
| 5,725,278 | A | 3/1998 | Verbeek | |
| 5,735,610 | A * | 4/1998 | Mark et al. | 384/42 |
| 5,765,920 | A | 6/1998 | Lai | |
| 5,791,734 | A | 8/1998 | Malenotti | |
| 5,951,107 | A | 9/1999 | Tornero | |
| 6,315,451 | B1 * | 11/2001 | Michioka et al. | 384/42 |

(Continued)

FOREIGN PATENT DOCUMENTS

| | | |
|---|---|---|
| CH | 199402 | 1/1938 |

(Continued)

*Primary Examiner*—Peter R. Brown

(57) ABSTRACT

The invention herein allows for manually positioning telescoping members relative to each other in a variety of positions within a given range of motion such as for movable chair backs or arms. A strut is engaged with and telescopically slides in a mounting member while deformable guide members provide for frictional engagement of the strut within the mounting member. A détente limits the range of motion of the strut relative to the mounting member. The détente comprises a stud or tab which engages a slot in the mounting member.

17 Claims, 9 Drawing Sheets

U.S. PATENT DOCUMENTS 6,409,266 B1 6/2002 Chen
6,460,954 B1 10/2002 Bayani et al.
6,572,195 B1 6/2003 Lee
6,585,336 B2 7/2003 Munday et al.
6,626,509 B2 9/2003 Remmers
6,652,050 B2 11/2003 Lin
6,659,560 B1 * 12/2003 Chi ..... 297/383
6,682,160 B2 1/2004 Kung

FOREIGN PATENT DOCUMENTS

DE 628881 4/1936
FR 81 23421 12/1981
GB 2 191 686 A 6/1986

* cited by examiner

FIG. 1
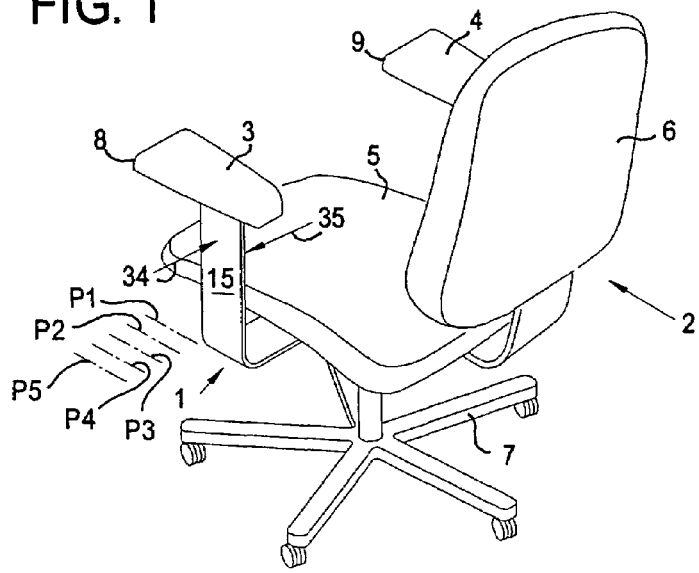
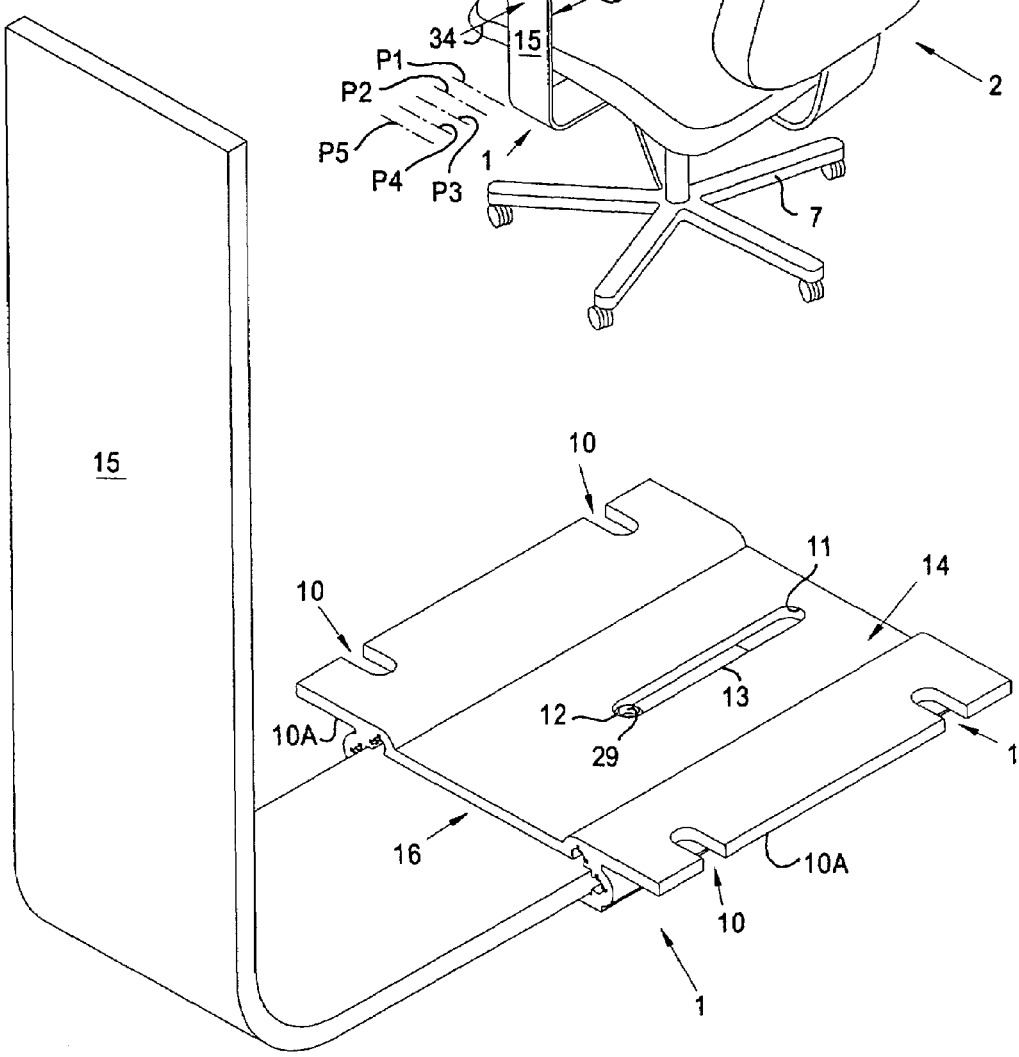
FIG.2

(PRIOR ART)

POSITIONING DEVICE FOR FURNITURE

FIELD OF THE INVENTION

The invention herein pertains to devices that provide positioning of structural members relative to one another and which are particularly useful in the furniture industry. Uses may include adjustable chair arms and other components to provide ergonomic comfort.

DESCRIPTION OF THE PRIOR ART AND OBJECTIVES OF THE INVENTION

Positioning mechanisms for chair arms, backs, seats and the like have long been known in the industry. U.S. Pat. Nos. 4,613,106; 4,616,812; 4,720,068: 4,749,230; 4,930,840; 5,338,133; 5,388,892; 5,586,811; 5,660,442 and 5,951,107 demonstrate a few of the known adjustable mechanisms that are commonly used. Certain prior devices utilize external knobs, clamps, and levers that are often difficult or hazardous to operate, and often cause the user to assume uncomfortable positions to adjust them. Today's ergonomic requirements in the market place and furniture industry demand user friendly, easily adjustable mechanisms that permit rapid and safe adjustment. Many prior positioning devices are complex and expensive to manufacture. In some cases, precision and smooth operation is sacrificed in favor of economy, causing such mechanisms to wobble or move in uneven paths during adjustment and operation. Some make excessive noise, or bind and cease to function altogether. In other cases, such as mechanisms that provide for discrete adjustment positions selectable by the use of levers, the user often struggles trying to find the most desired position.

Thus, with the problems and disadvantages of previous furniture positioning and adjusting devices, the present invention was conceived, and one of its objectives is to provide a precise and substantially wobble-free positioning device that an inexperienced user can adjust easily and intuitively.

It is also an objective of the present invention to provide a positioning device that can be easily assembled or repaired on the field by unskilled workers.

It is another objective of the present invention is to provide a positioning device that is inexpensive to manufacture, easy to install and is operational over a substantial range of manufacturing tolerances.

It is yet a further objective of the present invention is to provide a means for regulating the movement of telescoping members to substantially eliminate jerking or abrupt accelerations.

Various other objectives and advantages of the present invention will become apparent to those skilled in the art as a more detailed description is set forth below.

SUMMARY OF THE INVENTION

The aforesaid and other objectives are realized by providing a positioning device for ease in adjustability and positioning, for use in furniture. In the preferred embodiment of the invention, the user has only to provide an external force upon the strut of the positioning device to cause the strut to easily and precisely telescope within a mounting member. The positioning device is also provided with means for limiting the displacement of the strut relative to the mounting member so the strut can only telescope or slide for a limited distance while remaining at all times in sliding but controlled engagement within the mounting member.

The mounting member may be provided with guide means that include deformable elements held captive within channels thereof for sliding engagement with the strut. Additionally, the mounting member may be made as an integral feature of the seat pan of a chair instead of an add-on thereto.

The positioning device regulates the speed of movement by a deformable member inserted so as to contact both the strut and mounting member simultaneously to provide friction during motion. As a result, the force required to telescope the members can be made to remain substantially constant along the entire movement, thus minimizing abrupt accelerations of the strut. Alternately the positioning device may be provided with a deformable member for selective engagement in a variety of discrete positions.

BRIEF DESCRIPTION OF THE DRAWINGS

FIG. 1 shows a three-dimensional representation of a typical ergonomic chair that includes laterally adjustable arms with pads as utilizing the invention herein;

FIG. 2 demonstrates an enlarged three-dimensional view of the positioning device in its preferred form configured as a chair arm, without the arm pad;

DETAILED DESCRIPTION OF THE PREFERRED EMBODIMENT AND OPERATION OF THE INVENTION

Figures 3, 4:
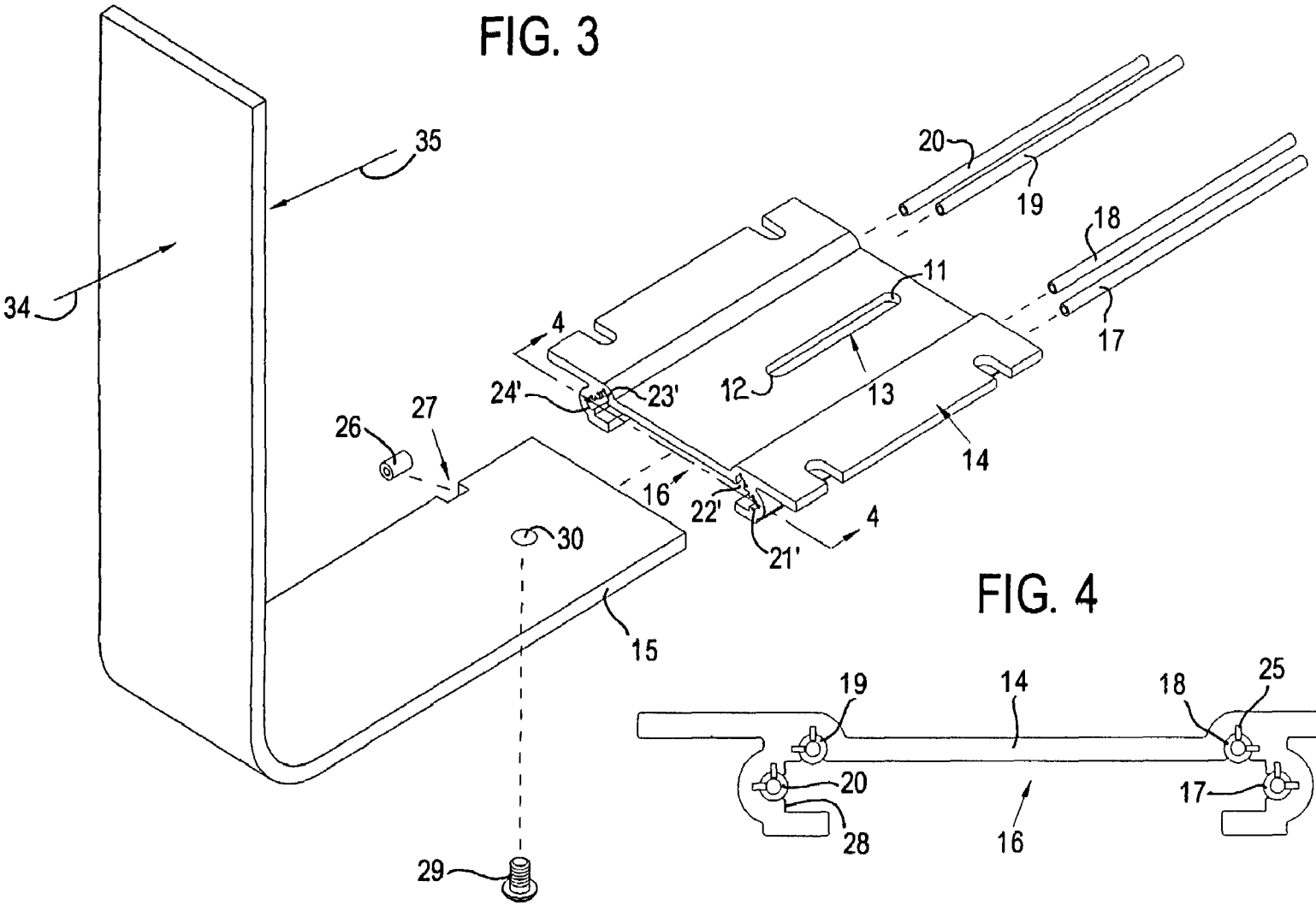
FIG. 3 depicts an exploded view of the positioning device of FIG. 2.
FIG. 4 features a front view of the mounting member 14 as seen along lines 4-4 of FIG. 3.

For a better understanding of the invention and its operation, turning now to the drawings, FIG. 1 shows standard chair 2 having preferred positioning device 1 installed thereon. Chair 2 comprises arms 3 and 4, seat 5, back 6, base 7 and arm pads 8 and 9. Shown enlarged in FIG. 2, positioning device 1 comprises mounting member 14 having mounting slots 10, flanges 10A, slot 13 having ends 11 and 12, and cavity 16 for slidably receiving strut 15. Mounting member 14 also includes channels 21'-24' for receiving deformable tubular guide members 17-20 shown in FIG. 3. Two positioning devices 1 are assembled as shown in FIG. 2, one for each of chair arms 3 and 4. Arms 3 and 4 are then mounted to the underside of chair seat 5 by means of mounting slots 10 in mounting flanges 10A with screws (not seen). Positioning devices 1 allow a chair occupant (not shown) to easily, manually horizontally position arms 3 and 4 relative to chair seat 5 in any of an infinite number of positions illustrated as P1, P2, P3, P4 and P5, etc., without tools, while seated. Slot ends 11 and 12 of slot 13 in FIG. 2 define the range of motion.

Figure 6:
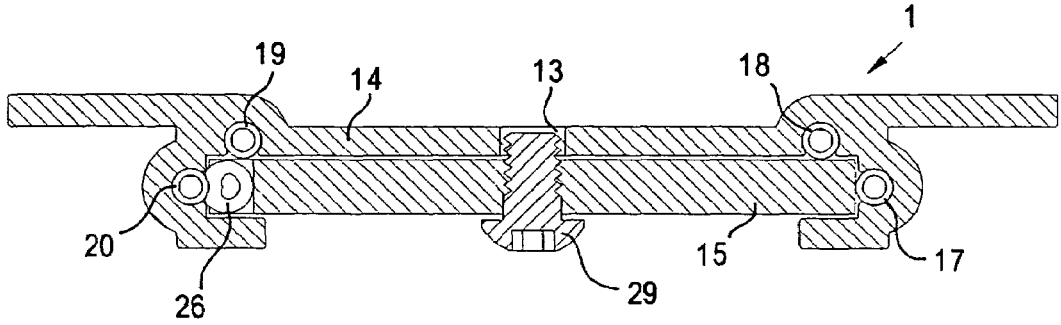
FIG. 6 illustrates a cross sectional view of the positioning device at a position of engagement corresponding to that shown in FIG. 5, along lines 6-6.

In FIGS. 3, 4 and 6, preferred positioning device 1 comprises mounting member 14, preferably formed as a metal extrusion rigidly affixed to chair seat 5 (not seen in FIGS. 3-6), and L-shaped strut 15. Strut 15 is slidably inserted into cavity 16 of mounting member 14 so that it is substantially free to telescope or slide therewithin. Deformable guide members 17, 18, 19 and 20 are longitudinally inserted into channels 21', 22', 23' and 24' respectively and are retained by displacement limiting means 25 integrally formed with mounting member 14 and positioned at the ends of channels 21'-24'. Deformable polymeric guide members 17-20, shown in FIG. 6 allow for smooth displacement of strut 15 relative to mounting member 14.

Shown in FIG. 3, resilient member 26 is inserted within cavity 27 of strut 15 to slide while contacting surface 28 (FIG. 4) and deformable guide member 20. Polymeric resilient member 26 provides speed control and a smooth, even movement by producing friction with guide member 20 during displacement of strut 15.

A détente means allows for limited displacement of strut 15 within mounting member 14 and includes stud 29. Stud 29 is threadably affixed within hole 30 of strut 15. Stud 29 is made of such length that it protrudes through strut 15 and hole 30 to slidably engage slot 13 in mounting member 14. Displacement of strut 15 is limited by stud 29 reaching ends 11 and 12 of slot 13, responsive to forces 34 or 35 (FIGS. 3, 5 and 7) as manually applied to strut 15.

Figure 5:
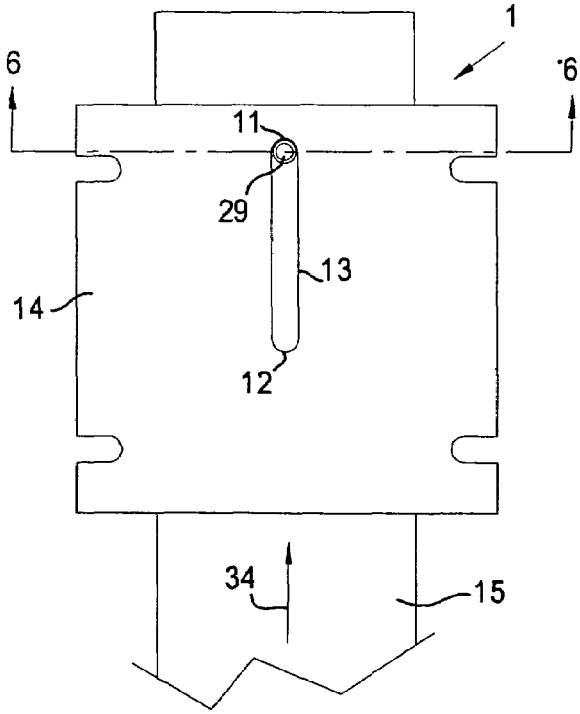
FIG. 5 pictures a top view of the positioning device as seen in FIG. 2 at an innermost position of engagement.
Figure 7:
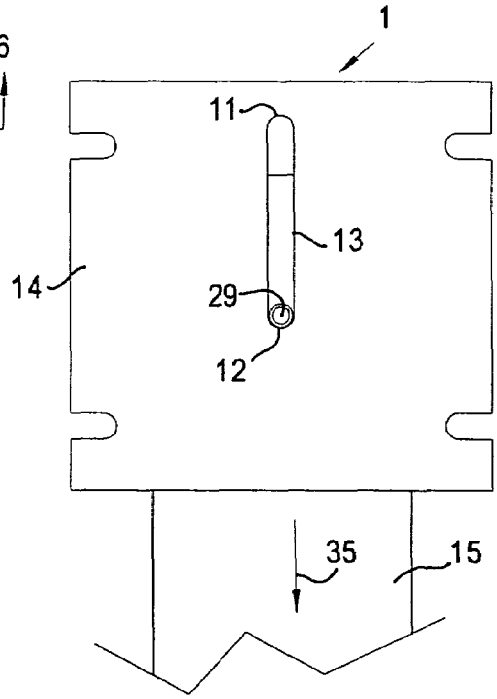
FIG. 7 shows a top view of the positioning device of FIG. 2 at an outermost position of engagement.

As shown in FIGS. 5 and 7, positioning device 1 is shown fully displaced responsive to force 34 so that stud 29 has contacted end 11 of slot 13 in mounting member 14 and further displacement of strut 15 is only possible responsive to opposite force 35. Strut 15 can be caused to move responsive to force 35 opposite force 34 and be selectively displaced to any of an infinite number of lateral positions as illustrated in FIG. 1.

Figure 8:
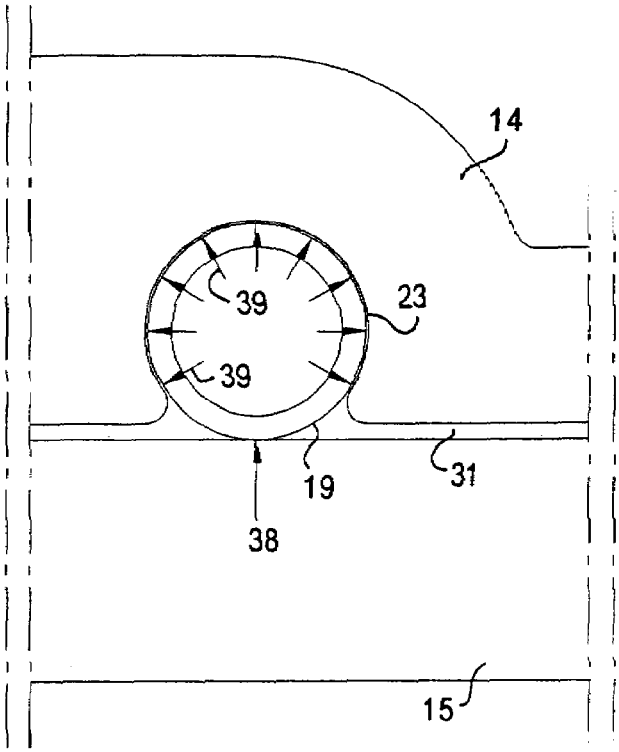
(PRIOR ART) FIG. 8
FIG. 8 depicts a front view of a guide element within a channel of the mounting member as used in prior art.

FIG. 8 depicts a prior art mounting member and shows guide member 19 within channel 23 of mounting member 14. When strut 15 is inserted within mounting member 14 it is tangent to tubular guide member 19 and produces load 38 that acts on and causes pressure 39 (illustrated by arrows 39) around the periphery of guide member 19. Guide member 19 cannot deform in channel 23 to an appreciable degree due to its close fit therewithin and strut 15 thus remains distant from mounting member 14 as seen by space 31.

Figure 9:
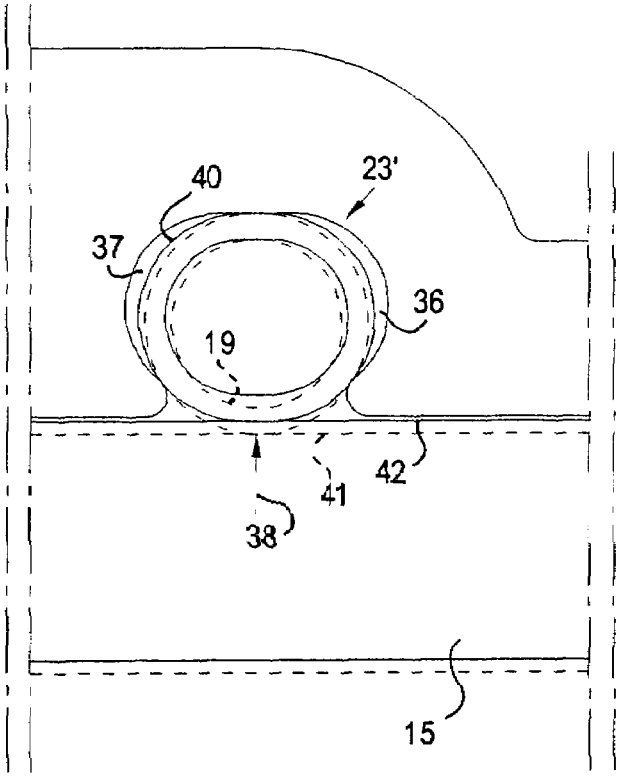
FIG. 9 demonstrates a front view showing a guide element within an elliptical channel of the mounting member of the present invention.

In FIG. 9 a new preferred channel shape is seen in channels 21', 22', 23' and 24' (only channel 23' is shown) each designed having an elliptical shape so as to provide peripheral cavities 36 and 37 to allow for easy deformation of guide member 19 when submitted to load 38. The somewhat deformed state 40 of guide member 19 (guide member 19 shown in FIG. 9 in dotted lines) allows guide member 19 to partially occupy peripheral cavities 36 and 37 of channel 23' so strut 15 is therefore able to displace from an initial position 41 (shown as dotted lines) to a new position 42. As would be understood channels 21', 22' and 24' are identical in shape to channel 23'. Thus the channel embodiment of FIG. 9 is more tolerant when strut 15 is undersized or oversized and reduces binding or looseness of strut 15 relative to mounting member 14 over a wider range of manufacturing conditions and tolerance.

Figure 10:
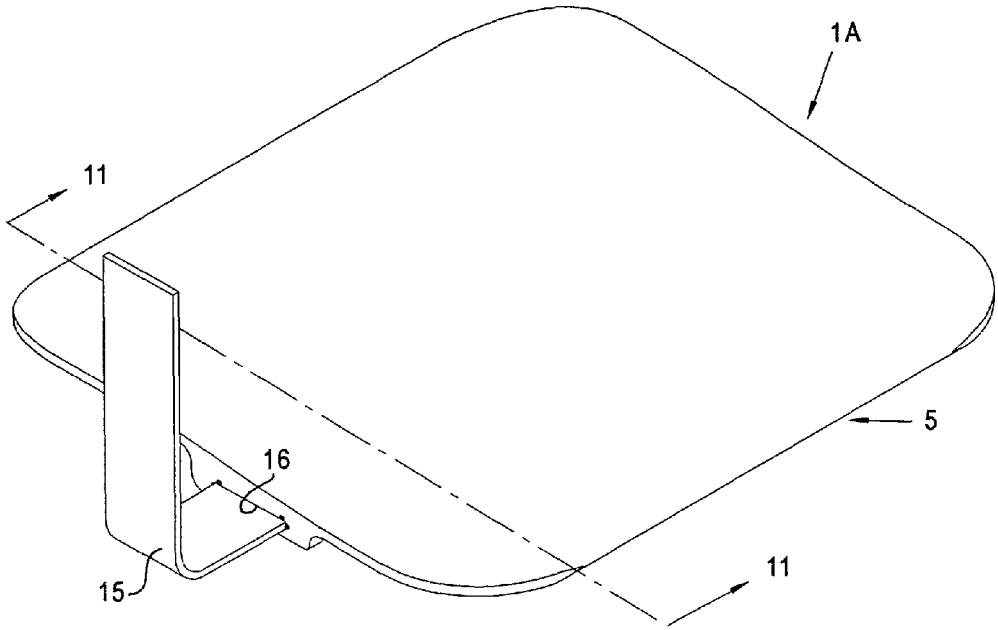
FIG. 10 illustrates a three-dimensional view of the mounting member configured as a chair seat.
Figure 11:
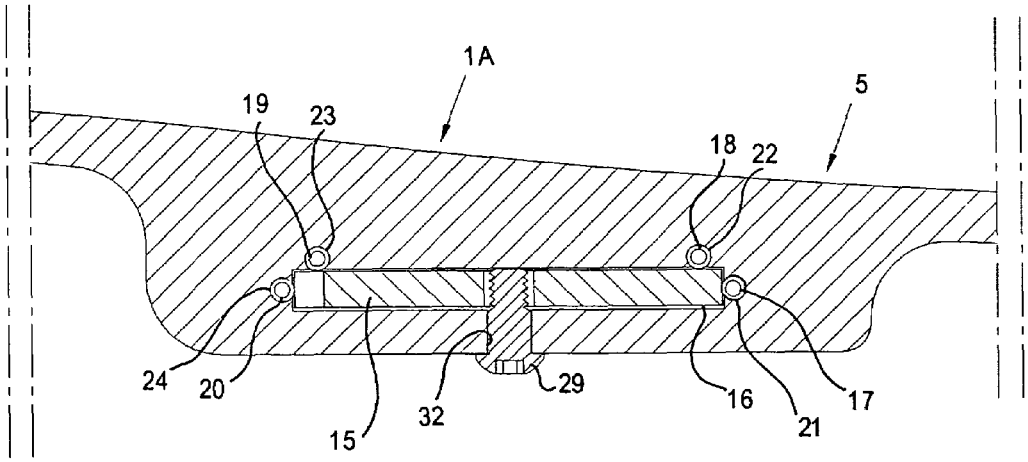
FIG. 11 shows a cross-sectional view of the chair seat of FIG. 10 seen along lines 11-11 thereof.

In an alternate embodiment of the invention, positioning device 1A is shown in FIGS. 10 and 11 with the mounting member integrally molded within chair seat 5 which is operational as earlier described. Chair seat 5 is preferably molded to include cavity 16, channels 21, 22, 23 and 24 (or preferred channels 21', 22', 23' and 24') to receive guide members 17-20 and slot 32. Strut 15 is inserted into cavity 16 and is retained in sliding engagement within cavity 16. Stud 29 is slidably engaged within slot 32 and affixed to strut 15 for limiting the displacement of strut 15 relative to cavity 16.

Figure 12:
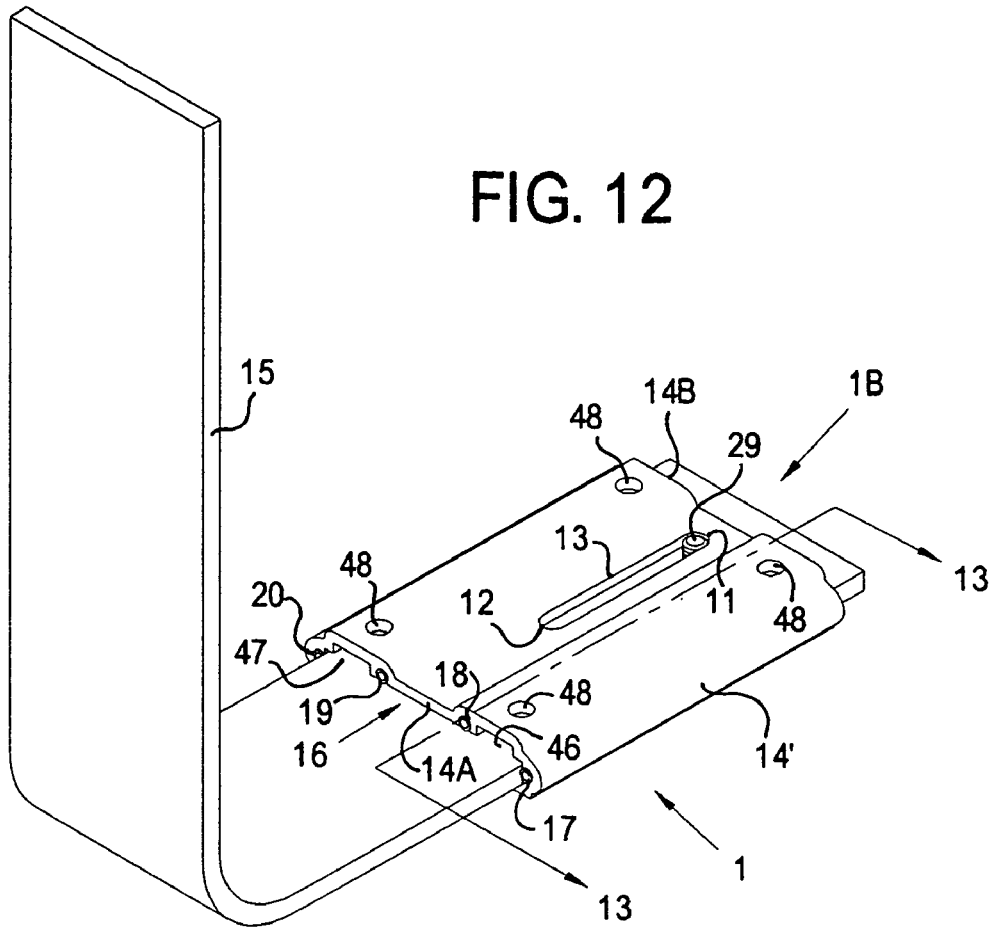
FIG. 12 demonstrates a three-dimensional view of a first alternate embodiment of the positioning device.

In FIG. 12, the invention is seen in a further alternate embodiment positioning device 1B comprises mounting member 14' provided with mounting channels 46 and 47 extending along the entire length of mounting member 14' in order to provide clearance for mounting screw heads (not seen). Holes 48 are provided centrally located near both ends of mounting channels 46 and 47 for inserting mounting screws (not shown). In this manner, mounting member 14' can be made so that mounting flanges 10A as seen in FIG. 2 are functionally replaced by mounting channels 46 and 47.

Figure 13:
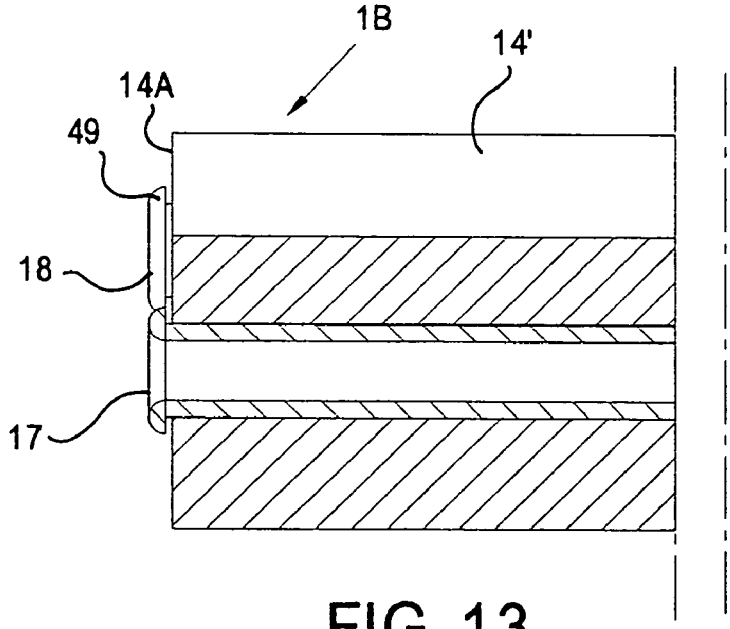
FIG. 13 features a partial cross-sectional view of the positioning device of FIG. 12 as seen along lines 13-13 of FIG. 12.

As seen in FIG. 13, a partial cross-sectional view of positioning device 1B shown in FIG. 12 is provided with securing means 49 integrally formed on both ends of guide members 17-20. Once in place securing means 49 are abutted against ends 14A and 14B of mounting member 14'. Forming of the securing means 49 is best accomplished by heat forming the ends of guide members 17-20. It is to be understood that securing means 49 can also be implemented on guides 17-20 as shown in FIGS. 2-11.

In another alternate embodiment shown in FIGS. 14-17, positioning device 1C comprises mounting member 14C and includes slot 13C comprising a series of notches 55-59 and teeth 51-54 on one side for selective engagement with flexible stud 50 attached in hole 60 of strut 15C. Stud 29C is slidably engaged within slot 13C and affixed to strut 15C for limiting the displacement of strut 15C relative to mounting member 14C between slot ends 11C and 12C.

During operation strut 15C is manually displaced responsive to force 34 sufficient to cause deformation of flexible stud 50 as it is alternately moved from a position of engagement concentric with notches 55-59 to a position tangent to teeth 51-54 of slot 13C. Flexible stud 50 is preferably made of a polymeric material and may contain cavity 50A to allow for additional deformation.

Figure 14:
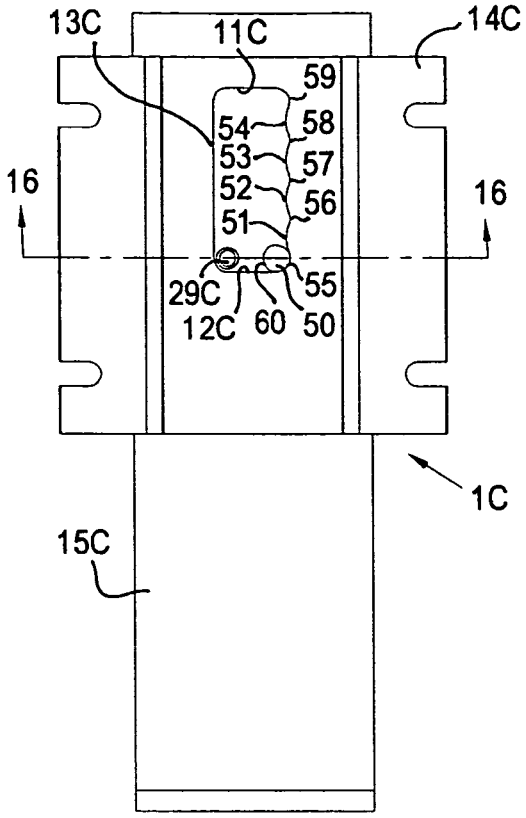
FIG. 14 pictures a top view of a second alternate embodiment of the positioning device of the invention.
Figure 15:
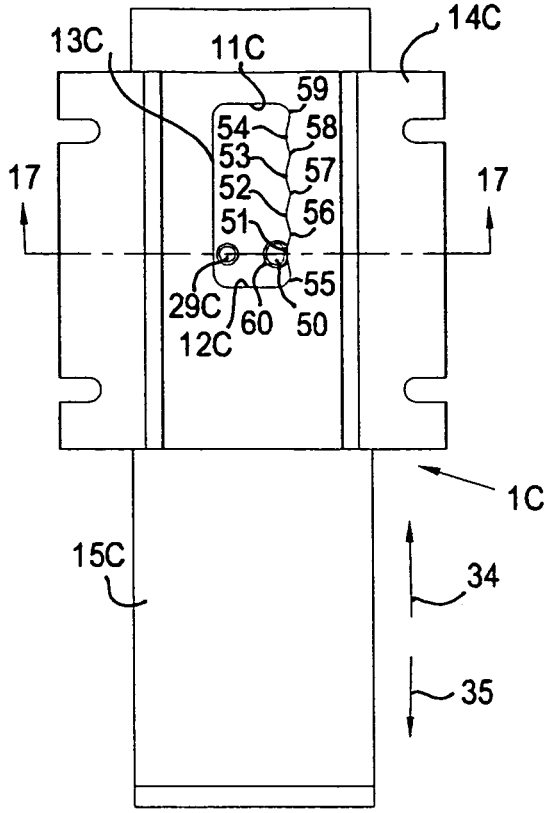
FIG. 15 illustrates a top view of the positioning device of FIG. 14 at an intermediate position of adjustment.
Figure 16:
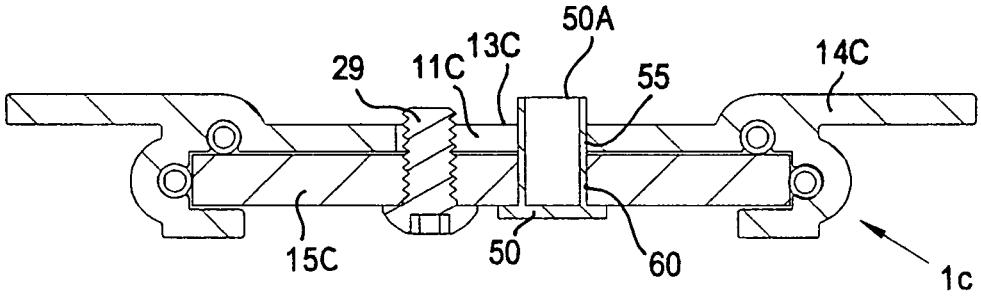
FIG. 16 depicts a cross-sectional view of the positioning device of FIG. 14 as seen along lines 16-16 thereof.
Figure 17:
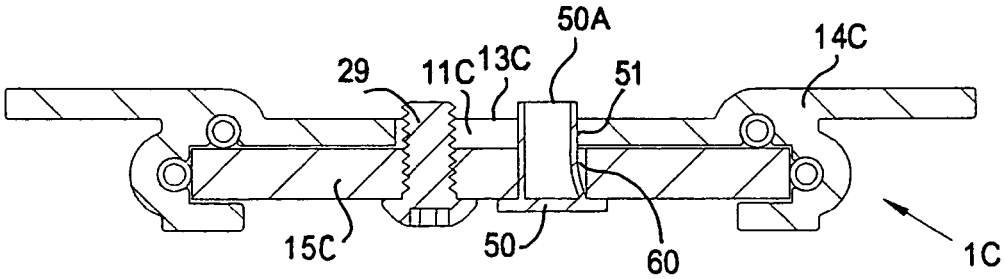
FIG. 17 features a cross-sectional view of the positioning device of FIG. 15 as shown along lines 17-17 thereof.
Figures 18, 19:
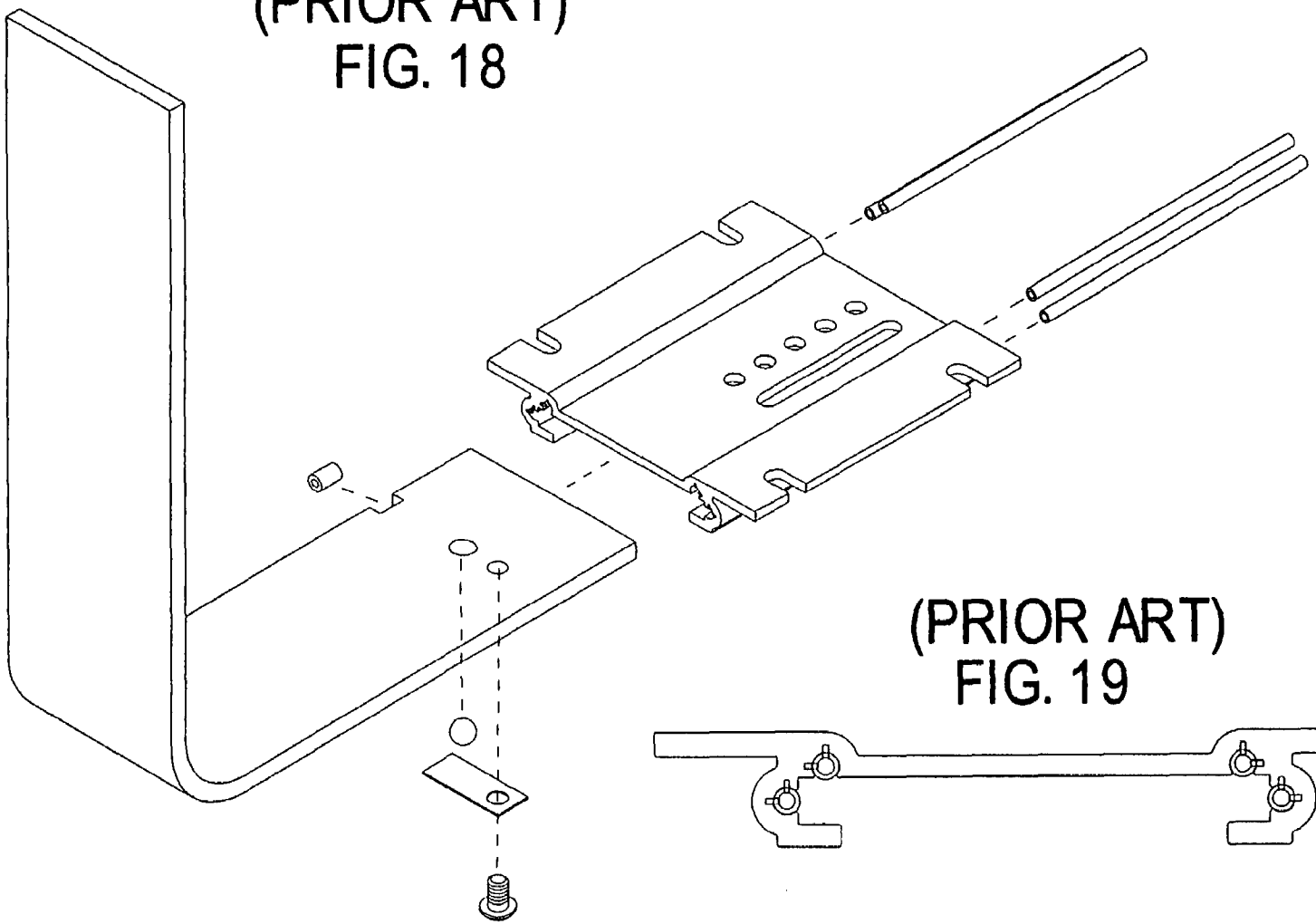
FIG. 18 (PRIOR ART)
FIG. 18 pictures an exploded view of a prior art positioning device.
FIG. 19 shows a front view of part of the positioning device seen in FIG. 18.
Figure 20:
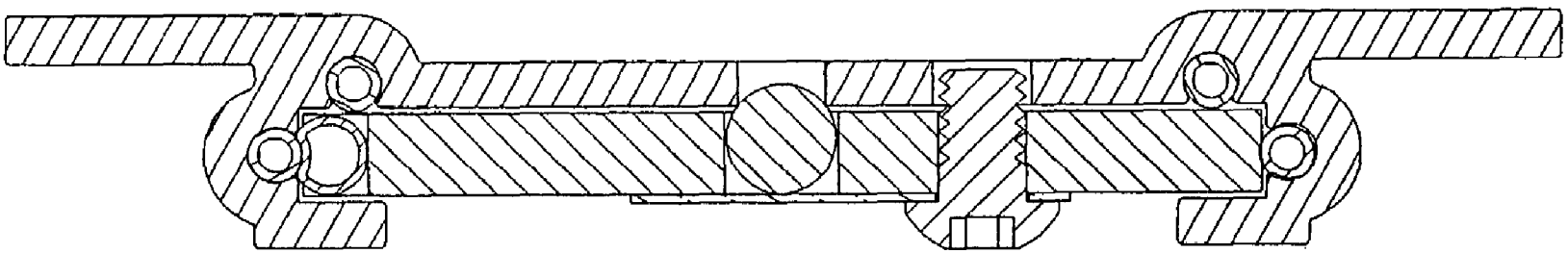
(PRIOR ART) FIG. 20
FIG. 20 depicts a cross-sectional view of the positioning device as seen in FIG. 18 but in assembled form.

In FIG. 16, positioning device 1C is shown in cross-sectional view of FIG. 14 at a position demonstrating the concentric engagement of plastic stud 50 with notch 55 of slot 13C. In FIG. 17, positioning device 1C is shown in a cross-sectional view of FIG. 15 and has been displaced responsive to force 34 to a position where flexible stud 50 is tangent to tooth 51 and causes flexible stud 50 to deform responsive to interference therebetween. It is to be understood that the selective displacement of strut 15C can be equally performed in the direction of force 34 or force 35. FIGS. 18-20 depict positioning devices of prior art.

While only one chair arm positioning device is discussed and illustrated herein, a typical employment of the invention would require use on both chair arms 3 and 4.

It is also to be understood that the use of the device is not limited to chair arms, it being also suitable to provide adjustable means for telescoping members intended for other purposes. It will be apparent that many useful modifications of the device are possible, without departing from the fundamental basis of the invention.

The illustrations and examples provided herein are for explanatory purposes and are not intended to limit the scope of the appended claims.

I claim:

1. A device for selectively positioning members relative to one another comprising;

a) a mounting member, said mounting member defining:
   1) a cavity, wherein said cavity is capable of accepting a strut member;
   2) an elliptical channel, wherein said elliptical channel is capable of accepting a tubular guide and oriented adjacent to said strut member; and
   3) a slot, said slot capable of accepting a stud, b) a strut member, said strut member slidably inserted into said cavity and movably disposed relative to said mounting member;

c) a means to limit displacement of said strut member within said cavity, said displacement limiting means comprising:
   1) a stud, said stud attached to said strut member and slidably disposed within said slot; and
   2) a tubular guide, said tubular guide within said elliptical channel and adjacent to said strut member.

2. The positioning device of claim 1 wherein said stud extends into said slot and moves between two extreme positions therewithin.

3. The positioning device of claim 1 wherein said strut member defines a notch, wherein said notch is capable of accepting a resilient member, a resilient member, said resilient member in frictional contact with said tubular guide.

4. The positioning device of claim 3 wherein said resilient member is a polymeric tube.

5. The positioning device of claim 1 wherein said mounting member is formed by extrusion.

6. The positioning device of claim 1 wherein said strut member is L-shaped.

7. The positioning device of claim 1 further comprising mounting flanges, said mounting flanges attached to said mounting member.

8. The positioning device of claim 1 wherein said mounting flanges define slots.

9. The positioning device of claim 1 further comprising means for engaging said strut member, said engaging means comprising:

a) a plurality of channels longitudinally disposed within said mounting member wherein said channels are capable of each accepting one tubular guide and are oriented adjacent to said strut member;

b) a plurality of tubular guides, said tubular guides disposed within said channels; and c) means for securing said tubular guides within said channels, said securing means attached to said mounting member.

10. The positioning device of claim 9 wherein said tubular guides comprise polymeric tubes.

11. The positioning device of claim 9 wherein said channels each provide a cavity surrounding said tubular guides.

12. The positioning device of claim 11 wherein said securing means are integrally formed on the ends of said guides.

13. The positioning device of claim 1 wherein said mounting member is a chair seat.

14. A device for selectively positioning members relative to one another comprising:

a) a mounting member, said mounting member defining:
   1) a cavity, wherein said cavity is capable of accepting a strut member;
   2) an elliptical channel, wherein said elliptical channel:
      i) is capable of accepting a tubular guide;
      ii) is oriented adjacent to said strut member while providing space for displacement of a tubular guide when force is exerted upon said tubular guide; and
   3) a deformable tubular guide, said tubular guide disposed within said elliptical channel; and b) a strut member, said strut member slidably inserted into said cavity and movably disposed relative to said mounting member.

15. The positioning device of claim 14 wherein said tubular guide is cylindrically shaped.

16. The positioning device of claim 14 wherein said mounting member is formed by extrusion.

17. The positioning device of claim 14 wherein:

a) said strut member is L-shaped; and b) said mounting member further defines an elongated slot for slidably receiving a protruding stud and a plurality of mounting slots for mounting the mounting member to the chair.

* * * * *